US010750773B2

(12) United States Patent
Yang et al.

(10) Patent No.: US 10,750,773 B2
(45) Date of Patent: Aug. 25, 2020

(54) RECONSTITUTED TOBACCO SHEETS AND RELATED METHODS

(71) Applicant: PHILIP MORRIS PRODUCTS S.A., Neuchatel (CH)

(72) Inventors: Szu-Sung Yang, Washington, D.C., WA (US); Vadim Migirin, Malaysa Kashtanovaya (RU)

(73) Assignee: Philip Morris Products S.A., Neuchatel (CH)

( * ) Notice: Subject to any disclaimer, the term of this patent is extended or adjusted under 35 U.S.C. 154(b) by 595 days.

(21) Appl. No.: 15/316,694

(22) PCT Filed: Jun. 22, 2015

(86) PCT No.: PCT/EP2015/063977
§ 371 (c)(1),
(2) Date: Dec. 6, 2016

(87) PCT Pub. No.: WO2015/197553
PCT Pub. Date: Dec. 30, 2015

(65) Prior Publication Data

US 2017/0181465 A1 Jun. 29, 2017

(30) Foreign Application Priority Data

Jun. 24, 2014 (EP) ..... 14173752

(51) Int. Cl.
*A24B 3/14* (2006.01)
*A24B 15/12* (2006.01)
*A24B 15/14* (2006.01)

(52) U.S. Cl.
CPC ..... *A24B 3/14* (2013.01); *A24B 15/12* (2013.01); *A24B 15/14* (2013.01)

(58) Field of Classification Search
None
See application file for complete search history.

(56) References Cited

U.S. PATENT DOCUMENTS

| | | | | |
|---|---|---|---|---|
| 3,464,422 | A * | 9/1969 | Osborne | A24B 15/12 131/353 |
| 3,483,874 | A * | 12/1969 | Hind | A24B 15/12 131/309 |
| 3,613,693 | A * | 10/1971 | Monte | A24B 15/12 131/370 |
| 4,542,755 | A | 9/1985 | Selke | |
| 5,584,306 | A * | 12/1996 | Beauman | A24B 3/14 131/355 |
| 8,007,637 | B2 | 8/2011 | Liu | |
| 2016/0208440 | A1 * | 7/2016 | Byrd, Jr. | A24D 1/02 |

FOREIGN PATENT DOCUMENTS

| | | |
|---|---|---|
| CN | 102640979 | 8/2012 |
| EP | 1872670 | 1/2008 |
| EP | 1489927 | 4/2014 |
| GB | 1203940 | 9/1970 |
| JP | 53-133700 | 11/1978 |
| JP | S53-133700 | 11/1978 |
| JP | 61-052269 | 3/1986 |
| JP | 61-247367 | 11/1986 |
| JP | 2009-504166 | 2/2009 |

OTHER PUBLICATIONS

PCT Search Report and Written Opinion for PCT/EP2015/063977 dated Sep. 2, 2015 (11 pages).
Database WPI, Jan. 1979, Thomas Scientific, London, GB, AN 1979-01095B XP002733281, Nishida H.; "Bulk Low Density Sheet Tobacco Prodn.—By Dispersing Tobacco Fibres, Accumulating on Running Conveyor, Moulding, Impregnating and Drying", & JP S 53 133700 A (Japan Tobacco & Salt Public) Nov. 21, 1978, abstract.
Office Action issued in China for Application No. 201580031799.3 dated Jul. 11, 2018 (27 pages). English translation included.
Jian, Zeng, "Effect of Pulping on the Properties of the paper Prepared from Tobacco Stem", Chemistry and Industry of Forest Products, vol. 32, No. 5, pages. 101-105, Oct. 2012. English translation included.
Office Action issued in Singapore for Application No. 11201609865 dated Aug. 23, 2018 (7 pages).
Extended European Search Report for Application No. 14173752 dated Dec. 8, 2014 (6 pages).
Office Action issued in China for Application No. 201580031799.3 dated Aug. 27, 2019, 29 pages. English translation included.
"Plant Fiber Chemistry", Tianjin Light Industry College et al., pp. 47-48, Light Industry Press, 1st Edition, published May 31, 1986 (7 pages). English translation included.
Office Action issued in China for Application No. 201580031799.3 dated May 16, 2019, 28 pages. English translation included.
Office Action issued in Japan for Application No. 2016-575461 dated Jun. 27, 2019, 9 pages. English translation included.
Pengcheng, Wei, "Cigarette Consumption Reduction Project", China Light Industry Press, 1st Edition, p. 181. English translation included.

* cited by examiner

*Primary Examiner* — Cynthia Szewczyk
(74) *Attorney, Agent, or Firm* — Mueting Raasch Group

(57) ABSTRACT

The invention relates to a reconstituted tobacco sheet having a basis weight of less than about (14) grams per square foot (about (151) grams per square metre) and comprising tobacco stem or stalk refined fibres having a length of at least about (300) micrometres and tobacco cast leaf material. There is further provided a method of making a reconstituted tobacco sheet, the method comprising preparing a dispersion of tobacco stems or stalks in a liquid, the dispersion having a consistency of at least about (10) percent by weight. The tobacco stems or stalks in the dispersion are refined to obtain a pulp suspension having a freeness (drainability) of at least about (30) degrees Schopper-Riegler and comprising tobacco stem or stalk fibres having a length of at least about (300) micrometres dispersed in the liquid. The pulp suspension is combined with tobacco cast leaf material to obtain a slurry, and a sheet is formed from the slurry.

4 Claims, No Drawings

RECONSTITUTED TOBACCO SHEETS AND RELATED METHODS

This application is a U.S. National Stage Application of International Application No. PCT/EP2015/063977, filed Jun. 22, 2015, which was published in English on Dec. 30, 2015, as International Publication No. WO 2015/197553 A1. International Application No. PCT/EP2015/063977 claims priority to European Application No. 14173752.8 filed Jun. 24, 2014.

The present invention relates to a reconstituted tobacco sheet and a method of making such reconstituted tobacco sheet. Further, the invention relates to tobacco products incorporating the reconstituted tobacco sheet.

There are several known methods for making reconstituted tobacco sheet. These several known methods may include processing tobacco material such as tobacco stems, tobacco stalks, leaf scraps and tobacco dust, which are produced during the manufacturing processes of tobacco products. Such manufacturing processes where the tobacco material may derive include stemming, aging, blending, cutting, drying, cooling, screening, sieving, shaping or packaging operations.

One of the known methods is to ground tobacco stems to a fine powder and then mix the tobacco stems with tobacco dust, guar gum, and water to form an aqueous slurry. This aqueous slurry may be then cast and dried to form a reconstituted tobacco sheet. However, this type of reconstituted tobacco sheet has a low tensile strength. In order to improve this characteristic of the reconstituted tobacco sheet, a non-tobacco cellulose, for example in the form of wood cellulose fibres, is usually added to the slurry as a binder. But, the presence of a non-tobacco ingredient is generally undesirable due to the increase in cost and negative impact on flavour attributed to this ingredient.

In other known methods, tobacco materials are mixed in an agitated tank with water to obtain a pulp. The soaking and mixing of the tobacco in the tank with water causes the water soluble components of the tobacco to dissolve into the liquid, creating a tobacco-flavoured liquid or tobacco juice. This tobacco-flavoured liquid subsequently needs to be separated from the non-soluble portion of the tobacco before further processing. By way of example, the pulp may be compressed or processed using a centrifuge to remove the tobacco-flavoured liquid containing the water-soluble components. The non-water-soluble portion then subsequently undergoes a paper-making process (for example, using a Fourdrinier machine) to form a base web. As is known, a Fourdrinier machine typically includes a forming section, a press section and a drying section. In the forming section, which comprises a plastic fabric mesh conveyor belt often referred to as a "wire", as it was once woven from bronze, the pulp is drained to create a continuous paper web. Subsequently, this wet web is fed onwards to the press section, where the excess water is squeezed out of the web. Finally, the pressed web is conveyed on through a heated drying section. The tobacco-flavoured liquid is also subjected to further processing using an evaporation operation to form a concentrated liquor, which may be added back to the base web in order to at least partly restore flavour to the base web that would otherwise be lost.

Dried reconstituted tobacco sheet typically displays a relatively limited tensile strength. In addition, the methods described above also have the drawback of high energy consumption due to the evaporation process. Further, even a partial loss of tobacco soluble components can have an undesirable impact on flavour.

Therefore, it would be desirable to provide an improved reconstituted tobacco sheet which preserves the tobacco flavour from the tobacco material. Further, it would be desirable to provide a reconstituted tobacco sheet that has an increased filling power. It would also be desirable to provide a reconstituted tobacco sheet which is better suited for withstanding mechanical stresses during the manufacture of tobacco products from the sheet.

It would also be desirable to provide a method of making a reconstituted tobacco sheet with a greater tensile strength than existing methods and can be obtained without the need for the sheet to be reinforced with undesirable non-tobacco cellulosic materials as binders. According to a first aspect of the invention there is therefore provided a method of making a reconstituted tobacco sheet, the method comprising preparing a dispersion of tobacco stems or stalks in a liquid, the dispersion having a consistency of at least about 10 percent by weight. The tobacco stems or stalks in the dispersion are refined to obtain a pulp suspension having a freeness (drainability) of at least about 30 degrees Schopper-Riegler and comprising tobacco stem or stalk refined fibres having a length of at least about 300 micrometres dispersed in the liquid. The pulp suspension comprising the tobacco stem or stalk refined fibres are combined with tobacco cast leaf material to obtain a slurry. A sheet is then formed from this slurry.

Further, according to another aspect of the invention, there is provided a reconstituted tobacco sheet having a basis weight of less than about 14 grams per square foot (about 151 grams per square metre) and comprising tobacco stem or stalk refined fibres having a length of at least about 300 micrometres and tobacco cast leaf material.

According to another aspect of the invention, there is, furthermore, provided a smoking article comprising reconstituted tobacco sheet material, wherein the reconstituted tobacco sheet material has a basis weight of less than about 14 grams per square foot (about 151 grams per square metre) and comprises tobacco stem or stalk refined fibres having a length of at least about 300 micrometres and tobacco cast leaf material.

It will be appreciated that any features described with reference to one aspect of the present invention are equally applicable to any other aspect of the invention.

The term "tobacco products" is used throughout this specification to refer to both combustible smoking articles and to smoking articles in which an aerosol forming substrate, such as tobacco, is heated rather than combusted. Combustible smoking articles, such as cigarettes, generally comprise shredded tobacco (usually in cut filler form) surrounded by a paper wrapper forming a tobacco rod. The shredded tobacco can be a single type of tobacco or a blend of two or more types of tobacco. A cigarette is employed by a consumer by lighting one end thereof and burning the shredded tobacco rod. The consumer then receives mainstream smoke by drawing on the opposite end (mouth end or filter end) of the cigarette. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

In the present specification, the term "stalk" is used to refer to the main structural portion of the tobacco plant that remains after the leaves, including the stem and lamina, have been removed. The stalk supports the tobacco leaves and connects them to the roots of the plant and has a high cellulosic content.

The term "stem" is used herein to refer to the structural portion of the tobacco plant connecting the lamina to the stalk, and also to the veins or ribs that extend through the leaves between the lamina portions. In the context of the present invention, the term "stem" does not encompass the term "stalk" and the stems and stalk of the tobacco plant are considered as distinct portions.

The term "consistency" is used throughout this specification to refer to the weight ratio of the solid fraction (that is, namely, the tobacco stems) to the biphasic system consisting of both tobacco stems and liquid in the liquid dispersion.

The term "refine" is used throughout the specification to mean that the tobacco stems or tobacco stalks in the liquid dispersion are subjected to a mechanical treatment that modifies the fibres of the stem or stalk material so that they can be formed into a sheet. For example, conical refiners or disc refiners of the type commonly used for wood pulp refining in the paper industry may be used to this purpose. This mechanical process is understood to exert an abrasive and bruising action on the tobacco stem or tobacco stalk fibres such that they are broken, deformed, delaminated and declustered, yet not so damaged that they lose too much of their strength. Accordingly, hair-like, thin and elongated "tobacco stem or tobacco stalk refined fibres" may be obtained from tobacco stems or tobacco stalks. These tobacco stem or tobacco stalk refined fibres are pliable and have greater surface area. This is understood to significantly improve inter-fibre bonding ability, in that it is appears to favour the formation of hydrogen bonds between overlying strands.

By the term "fibre length", reference is made throughout the specification to the major dimension of a fibre obtained by refining tobacco stems by a method according to the invention. More particularly, reference is generally made to the average value of the fibre length as measured on a sample of the tobacco stem fibres. Average fibre length may be assessed experimentally by several methods. For example, fibre length may be measured by microscope analysis.

The term "cast leaf" is used herein to refer to a process that is well known in the art and that is based on casting a slurry comprising ground tobacco particles and a binder (for example, guar) onto a supportive surface, such as a belt conveyor, drying the slurry and removing the dried sheet from the supportive surface. The term "tobacco cast leaf material" is used herein to refer to the portions of the tobacco leaf and to the recoverable fine material generated during processing (for example, tobacco dust) that are normally used in a conventional cast leaf process.

The term "freeness" is used throughout this specification to refer to the drainability of a pulp product. The "freeness" is defined by the 2014 publication of the International Standard ISO 5267-1 entitled: Determination of Drainability—Part 1: Schopper-Riegler Method. The Schopper-Riegler test is designed to provide a measure of the rate at which a dilute suspension of pulp may be dewatered. It has been shown that drainability is related to the surface conditions and swelling of the fibres, and constitutes a useful index of the amount of mechanical treatment to which the pulp has been subjected. Therefore, it shall be clear for the skilled reader that, by indicating the value of freeness or drainability of a pulp obtained by a refining operation, reference is indirectly being made to the intensity and amount of mechanical treatment (for example, in terms of net energy input) to which said pulp has been subjected in the refining operation. Freeness (drainability) may be expressed in degrees Schopper-Riegler. The pulp is prepared in accordance with the test conditions defined in the above identified ISO standard. A volume of 1000 ml of the prepared pulp is poured into the drainage chamber. The discharge from the bottom and side orifices is collected. The filtrate from the side orifice is measured in a special cylinder, graduated in SR degrees. A discharge of 1000 millilitres corresponds to 0 degrees Schopper-Riegler while a discharge of 0 millilitres corresponds to 100 degrees Schopper-Riegler.

The term "tensile strength" is used throughout the specification to indicate a measure of the force required to stretch a reconstituted tobacco sheet until it breaks. More specifically, the tensile strength is the maximum tensile force per unit width that the sheet material will withstand before breaking and is measured in the machine direction of the sheet material. It is expressed in units of Newtons per meter of material (N/m). Tests for measuring the tensile strength of a sheet material are well known. A suitable test is described in the 2014 publication of the International Standard ISO 1924/2 entitled "Paper and Board—Determination of Tensile Properties—Part 2: Constant Rate of Elongation Method".

The test utilises tensile testing apparatus which is designed to extend a test piece of given dimensions at an appropriate constant rate of elongation and to measure the tensile force and, if required, the elongation produced. Each test piece of sheet material is held in two clamps, the separation of which is adjusted at a specified rate. For example, for a 180 millimeters test length the rate is 20 millimeters per minute. The tensile force is measured as a function of elongation and the test is continued until the test piece ruptures. The maximum tensile force is measured, as well as the elongation at break.

The tensile strength of the material may be calculated from the following equation in which S is the tensile strength in N/m, $\overline{F}$ is the mean tensile force in Newton and w is the width of the test piece in metres:

$$S = \frac{\overline{F}}{w}$$

A reconstituted tobacco sheet according to the invention has a basis weight of less than about 14 grams per square foot (about 151 grams per square metre). Further, the reconstituted tobacco sheet is formed from tobacco stem or tobacco stalk refined fibres having a length of at least about 300 micrometres and tobacco cast leaf material. A tobacco stem or tobacco stalk refined fibre length of at least about 300 micrometres has been found to ensure satisfactory inter-fibre bonding and, as a consequence, to favour the formation of a sheet material having desirable mechanical properties.

Preferably, the reconstituted tobacco sheet has a basis weight of less than about 11 grams per square foot (about 119 grams per square metre). Because the basis weight of the reconstituted tobacco sheet is reduced, the filling power of the reconstituted tobacco sheet is improved. Thus, the overall tobacco weight in smoking articles may advantageously be reduced.

The term "filling power" is used throughout this specification to refer to the volume of space taken up by a given weight or mass of a tobacco material. The greater the filling power of a tobacco material, the lower the weight of the material required to fill a tobacco rod of standard dimensions. The values of filling power are expressed in terms of corrected cylinder volume (CCV), which is the cylinder volume (CV) of the tobacco material at a reference moisture level of 12.5% oven volatiles. The cylinder volume (CV) may be determined using a Borgwaldt densimeter DD60 or DD60A type fitted with a measuring head for cut tobacco and a tobacco cylinder container.

In a suitable method for determining the value of CCV, a sample of the cut filler is placed in the tobacco cylinder container of the Borgwaldt densimeter and subjected to a load of 2 kg for 30 seconds. The height of the sample after the loading time has expired is measured and this is converted to a cylinder volume using the formula:

$$CV = \frac{r^2 \cdot h \cdot \pi}{SW \cdot 10}$$

where r is the cylinder radius (3.00 cm for the densimeter indicated above), h is the height of the sample after the loading time has expired and SW is the weight of the sample. The measured CV is then converted to a corrected value of CCV at the reference moisture level value (ROV) of 12.5% oven volatiles, using the formula:

$$CCV=(OV-ROV)\cdot f+CV$$

where OV is the actual % oven volatiles of the sample of tobacco stems and f is a correction factor (0.4 for the test indicated).

The term "% Oven Volatiles" (% OV or percent OV) is used to refer to the moisture content of the tobacco stems. It is determined by measuring the percentage weight loss from the stems upon drying a sample of the stem material in an oven at 100±1 degrees Centigrade (° C.) for 3 hours±0.5 minutes. In practice, it is assumed that a significant majority of the weight loss from the stems results from the evaporation of moisture. It should be noted that, on an absolute basis, the values of moisture content determined by oven drying may be greater than the results of water content analysis when using a specific method such as ISO 6488 (Karl Fischer method). The difference is sample-type dependent and is due to the loss of volatile materials other than water from the tobacco material during oven drying.

Preferably, the tobacco stem or tobacco stalk refined fibres have a length of less than about 1200 micrometres. Even more preferably, the tobacco stem or tobacco stalk refined fibres have a length of less than about 1000 micrometres. In some preferred embodiments, the tobacco stem or tobacco stalk refined fibres have a length from about 300 to about 1200 micrometres, preferably from about 300 to about 1000 micrometres. It has been found that tobacco stem or tobacco stalk refined fibres having such fibre length may effectively contribute to improving the tensile strength of a reconstituted tobacco sheet formed from them. Without being bound to theory, it is thought that tobacco stem or tobacco stalk refined fibres having such fibre length provide a suitable amount of surface area for inter-fibre bonding.

The reconstituted tobacco sheet contains at least about 10 percent by weight of the dry sheet of tobacco stem or tobacco stalk refined fibres. Preferably, the tobacco stem or tobacco stalk refined fibres account for at least about 30 percent by weight of the dry sheet. More preferably, the tobacco stem or tobacco stalk refined fibres account for at least about 40 percent by weight of the dry sheet. In addition, or as an alternative, the reconstituted tobacco sheet contains less than about 80 percent by weight of the dry sheet of tobacco stem or tobacco stalk refined fibres. In some preferred embodiments, the tobacco stem or tobacco stalk refined fibres account for from about 30 percent by weight of the dry sheet to about 50 percent by weight of the dry sheet, even more preferably from about 40 percent by weight of the dry sheet to about 50 percent by weight of the dry sheet. It has surprisingly been found that higher contents of tobacco stem or tobacco stalk refined fibres having a length of at least about 300 micrometres may result in a significantly increased tensile strength of the reconstituted tobacco sheet, as will be shown by the Examples below.

The reconstituted tobacco sheet may have a tensile strength of at least about 20 kilogram force per meter (about 196 Newtons per meter). Preferably, the reconstituted tobacco sheet has a tensile strength of at least about 25 kilogram force per meter (about 245 Newtons per meter). More preferably, the reconstituted tobacco sheet has a tensile strength of at least about 30 kilogram force per meter (about 294 Newtons per meter). Such improved values of tensile strength make the reconstituted tobacco sheet according to the present invention particularly suitable for subsequent operations involving mechanical stresses.

The reconstituted tobacco sheets according to the invention find particular application in the manufacture of tobacco products, including combustible smoking articles and smoking articles in which an aerosol forming substrate, such as tobacco, is heated rather than combusted. In more detail, after forming, a reconstituted tobacco sheet can be dried and further shaped and cut. In a preferred embodiment, the reconstituted tobacco sheet is cut to form strips that are cut with other forms of tobacco strips to form a mixed cut filler that can be used to manufacture a reconstituted tobacco product, such as a tobacco rod or an aerosol forming substrate to be heated rather than combusted. Alternatively, the reconstituted tobacco sheet may be cut independently to form a reconstituted tobacco cut filler component, and then the reconstituted tobacco cut filler component can then be blended with other filler components. In particular, a reconstituted tobacco material formed from a reconstituted tobacco sheet according to the present invention can be blended with other tobaccos to form a cut filler. Such cut filler may include, but is not limited to, shreds of flue-cured tobacco, Burley tobacco, Maryland tobacco, Oriental tobacco, rare tobacco, specialty tobacco, reconstituted tobacco, expanded tobacco and the like. The cut filler can also include conventional additives, for example humectants, such as glycerine and propylene glycol.

In a method of making a reconstituted tobacco sheet according to the invention, a dispersion of tobacco stems in a liquid medium, such as for example water, is prepared with a consistency of at least about 10 percent by weight. The tobacco stems or stalks are refined in the dispersion to obtain a pulp suspension having a freeness (drainability) of at least about 30 degrees Schopper-Riegler and comprising tobacco stem or tobacco stalk refined fibres having a length of at least about 300 micrometres dispersed in the liquid. The pulp suspension thus obtained is then combined with tobacco cast leaf material to obtain a slurry. A sheet is then formed from this slurry.

Because substantially all the soluble fraction (also often referred to as "tobacco juice") is kept within the liquid dispersion, most flavour sources are advantageously preserved. At the same time, because there is no need to concentrate by evaporation a liquid phase separated from the non-soluble portion of the tobacco stems, as is the case with certain known processes, the overall energy consumption associated with the method according to the present invention is advantageously reduced. Further, the need to introduce non-tobacco cellulosic material is substantially eliminated altogether, because the tobacco stem or tobacco stalk refined fibres obtained by refining the dispersion of tobacco stems or tobacco stalks in the liquid medium provide sufficiently solid inter-fibre bonds. In general, this results in an improved tensile strength of reconstituted tobacco sheets obtainable by the method. Further, the higher content of fibrous material may result in a particularly rough, wavy surface texture of the reconstituted tobacco sheet. Thus, the filling power of the reconstituted tobacco may be advantageously increased.

Preferably, the dispersion of tobacco stems is prepared with a consistency of at least about 15 percent by weight. More preferably, the dispersion of tobacco stems or tobacco stalks is prepared with a consistency of at least about 20 percent by weight. Thus, substantially all the tobacco flavour sources that would be lost as soluble components in a conventional process, and therefore would need to be reintroduced in a reconstituted tobacco material, are advantageously preserved. The dispersion of tobacco stems may be prepared with a consistency of less than about 70 percent by weight. Preferably, the dispersion is prepared with a consistency of less than about 60 percent by weight.

Preferably, the tobacco stems are refined to obtain a pulp suspension comprising tobacco stem or tobacco stalk refined fibres having a length of less than about 1200 micrometres. More preferably, the tobacco stems are refined to obtain a pulp suspension comprising tobacco stem or tobacco stalk refined fibres having a length of less than about 1000 micrometres. In a preferred embodiment, the tobacco stems are refined to obtain a pulp suspension comprising tobacco stem or tobacco stalk refined fibres having a length from about 300 micrometres to about 600 micrometres.

Preferably, the tobacco stems or tobacco stalks in the dispersion are refined to obtain a pulp suspension having a freeness (drainability) of at least about 50 degrees Schopper-Riegler.

In a preferred embodiment, the tobacco stems or tobacco stalks may be disc refined. In more detail, the step of refining the tobacco stems or tobacco stalks in the dispersion may comprise a first step of refining the tobacco stems between discs separated by a first gap and a second step of refining the tobacco stems between discs separated by a second gap smaller than the first gap. Preferably, the second step of refining the tobacco stems or tobacco stalks between discs separated by a second gap smaller than the first gap is performed at least twice.

Without being bound to theory, it has been observed that the first refining step substantially turns the liquid dispersion of tobacco stems or tobacco stalks into a rather coarse pulp, wherein stem or tobacco stalk fibres have not yet been properly separated, whereas the second refining step substantially turns the coarse pulp obtained from the first refining step into a much finer pulp suspension.

The first gap may be less than about 1000 micrometres. Preferably, the first gap is less than about 750 micrometres. More preferably, the first gap is less than about 500 micrometres.

The second gap may be less than about 500 micrometres. Preferably, the second gap is less than about 350 micrometres. More preferably, the second gap is less than about 200 micrometres.

In addition, or as an alternative, the second gap may be more than about 50 micrometres. Preferably, the second gap may be more than about 100 micrometres. More preferably, the second gap may be more than about 200 micrometres.

In a preferred embodiment, the first gap is about 500 micrometres and the second gap is about 50 micrometres.

The invention will be further described with reference to the following, non-limiting examples.

COMPARATIVE EXAMPLE

A reconstituted tobacco sheet was prepared according to a conventional cast leaf process with the following composition:

Tobacco material:

Lamina dust: 66 percent by dry weight

Ground stem: 34 percent by dry weight

Binder:

Guar: 8 parts by dry weight per 100 parts of dry tobacco material

The dry tobacco material was fed to a grinder where it was dry ground and screened and subsequently contacted with an aqueous medium including guar as the binder in a high-shear mixer to form a tobacco slurry. The tobacco slurry was then cast onto a moving endless belt. The cast slurry was subsequently passed through a drying assembly to remove moisture so as to form a reconstituted tobacco sheet. Finally, the sheet was removed from the belt with a doctor blade.

A reconstituted tobacco sheet was obtained with a basis weight of 12.5±0.5 grams per square foot (about 135 grams per square metre) and a tensile strength of about 25 kgf/m (about 245 N/m).

Example 1

A reconstituted tobacco sheet was prepared by a method according to the present invention with the following composition:

Tobacco material:

Lamina dust: 66 percent by dry weight

Stem fibres: 30 percent by dry weight

Binder:

Guar: 4 parts by dry weight per 100 parts of dry tobacco material

In more detail, tobacco stems were dispersed in water with a consistency of more than 50 percent. Subsequently, the tobacco stems were refined in the dispersion to obtain a pulp suspension having a freeness (drainability) of about 25 degrees Schopper-Riegler. Tobacco stem fibres having an average length of about 450 micrometres were obtained. The tobacco stem fibres thus obtained were mixed with humectants, binders and tobacco dust to form a slurry, which was then cast to form a sheet and let dry.

A reconstituted tobacco sheet was obtained with a basis weight of 13 grams per square foot (about 140 grams per square metre) and a tensile strength of about 26 kgf/m (about 255 N/m).

Example 2

A reconstituted tobacco sheet has been prepared by a method according to the present invention with the following composition:

Tobacco material:

Lamina dust: 57 percent by dry weight

Stem fibres: 43 percent by dry weight.

Binder:

Guar: 8 parts by dry weight per 100 parts of dry tobacco material.

In more detail, tobacco stems were dispersed in water with a consistency of more than 50 percent. Subsequently, the tobacco stems were refined in the dispersion to obtain a pulp suspension having a freeness (drainability) of about 30 degrees Shopper Riegler. Tobacco stem fibres having an average length of about 400 micrometres were obtained. The tobacco stem fibres thus obtained were mixed with humectants, binders and tobacco dust to form a slurry, which was then cast to form a sheet and let dry.

A reconstituted tobacco sheet was obtained with a basis weight of about 11 grams per square foot (about 118 grams per square metre) and a tensile strength of about 35 kgf/m (about 343 N/m).

The invention claimed is:

1. A method of making a reconstituted tobacco sheet, comprising:

preparing a dispersion of tobacco stems or stalks in a liquid, the dispersion having a consistency of at least about 10 percent by weight, wherein the consistency refers to a weight ratio of a solid fraction to both the solid fraction and liquid in the liquid dispersion, and the solid fraction is tobacco stems and stalks;

refining the tobacco stems or stalks in the dispersion to obtain a pulp suspension having a freeness (drainability) of at least about 30 degrees Schopper-Riegler and comprising tobacco stem or stalk refined fibres having a length from about 300 micrometres to about 450 micrometres dispersed in the liquid;

combining the pulp suspension with tobacco cast leaf material to obtain a slurry; and forming a sheet from the slurry, wherein the reconstituted tobacco sheet has a tensile strength of at least about 25 kilogram force per meter (about 245 Newtons per meter).

2. A method according to claim 1, wherein the consistency of the dispersion of tobacco stems or tobacco stalks is at least about 15 percent by weight.

3. A method according to claim 1, wherein the consistency of the dispersion of tobacco stems or tobacco stalks is less than about 20 percent by weight.

4. A method according to claim 1, wherein the step of refining the tobacco stems or tobacco stalks comprises a first step of refining the tobacco stems or tobacco stalks between discs separated by a first gap and a second step of refining the tobacco stems or tobacco stalks between discs separated by a second gap smaller than the first gap.

* * * * *